US005232760A

United States Patent [19]

Calcaterra et al.

[11] Patent Number: 5,232,760

[45] Date of Patent: Aug. 3, 1993

[54] METHOD AND COMPOSITION TO ENHANCE ACID DYE STAIN RESISTANCE OF POLYAMIDES BY IMPROVING RESISTANCE TO DETERGENT WASHINGS AND PRODUCTS THEREOF

[75] Inventors: Lidia T. Calcaterra; Mathias P. Koljack, both of Arlington Heights, Ill.

[73] Assignee: Allied Signal Inc., Morristownship, Morris County, N.J.

[21] Appl. No.: 868,930

[22] Filed: Jun. 4, 1992

Related U.S. Application Data

[62] Division of Ser. No. 649,501, Feb. 1, 1991.

[51] Int. Cl.[5] ..... B32B 33/00

[52] U.S. Cl. ..... 428/96; 428/475.8

[58] Field of Search ..... 428/96

[56] References Cited

U.S. PATENT DOCUMENTS

| | | | |
|---|---|---|---|
| 2,609,350 | 9/1952 | Spatt | 427/393.4 |
| 3,684,562 | 8/1972 | Pascall | 427/393.4 |
| 3,706,594 | 12/1972 | Wasley et al. | 427/393.4 |
| 3,843,388 | 10/1974 | Heuring | 427/393.1 |
| 3,995,998 | 12/1976 | Rowland et al. | 427/393.4 |
| 5,074,883 | 12/1991 | Wang | 427/393.4 |
| 5,118,551 | 6/1992 | Calcaterra et al. | 8/557 |

FOREIGN PATENT DOCUMENTS

| | | |
|---|---|---|
| 0328822 | 8/1989 | European Pat. Off. . |
| 0329899 | 8/1989 | European Pat. Off. . |
| 2357681 | 2/1978 | France . |

*Primary Examiner*—James C. Cannon
*Attorney, Agent, or Firm*—Wayne W. Rupert

[57] ABSTRACT

A method of imparting acid dye stain resistance to polyamide substrates having improved durability of the stain resistance to detergent washings comprising treating the polyamide substrate with an effective amount of a mixture of phenyl vinyl ether/maleic diacid copolymer and 2-(4-hydroxymethyl-phenoxy)-ethyl vinyl ether/-maleic diacid copolymer, wherein the phenyl vinyl ether/maleic diacid copolymer is the stain resist agent, and the 2-(4-hydroxymethyl-phenoxy)-ethyl vinyl ether/maleic diacid copolymer is added to improve the durability of the stain resist agent.

1 Claim, No Drawings

METHOD AND COMPOSITION TO ENHANCE ACID DYE STAIN RESISTANCE OF POLYAMIDES BY IMPROVING RESISTANCE TO DETERGENT WASHINGS AND PRODUCTS THEREOF

This application is a division of application Ser. No. 649,501, filed Feb. 1, 1991.

BACKGROUND OF THE INVENTION

The present invention relates to methods and compositions capable of imparting stain resistance to polyamide textile substrates, as well as to the treated substrates themselves, and more particularly to methods of application and compositions useful for imparting acid dye stain resistance to polyamide carpet substrates, whereby the stain resist agent is resistant to detergent washings, and yellowing.

More specifically, the improvement relates to the use of an effective amount of a composition of the class consisting essentially of: a) a mixture of phenyl vinyl ether/maleic diacid copolymer and 2-(4-hydroxymethyl-phenoxy)-ethyl vinyl ether/maleic diacid copolymer; b) a copolymer obtained by the reaction of phenyl vinyl ether, 2-(4-hydroxymethyl-phenoxy)-ethyl vinyl ether and maleic anhydride; and c) mixtures thereof to provide economical, anti-yellowing stain resistant agents for nylon carpeting and the like which are resistant to detergent washing.

PRIOR ART

Polyamide textile substrates such as carpeting and upholstery fabrics are capable of being permanently discolored or stained by certain colorants like food or beverage dyes. It is known to use sulfonated aromatic formaldehyde condensates: a) in a yarn finish during or after fiber quenching (U.S. Pat. No. 4,680,212), b) in a dye bath (U.S. Pat. No. 4,501,591), or c) incorporated into the fiber (U.S. Pat. No. 4,597,762), all for the purpose of improving stain resistance of carpet fiber. Commonly assigned U.S. Ser. No. 101,652, filed Sep. 28, 1987 (International Publication No. WO 89/0294) entitled "Improved Methods and Compositions to Enhance Stain Resistance of Carpet Fibers", and now abandoned, discloses improved methods utilizing application of sulfonated aromatic condensates to enhance stain resistance of dyed nylon carpet fibers. Further, commonly assigned patent application U.S.S.N. 500,813, filed Mar. 28, 1990 entitled "Method to Impart Coffee Stain Resistance to Polyamide Textile Substrates" now U.S. Pat. No. 5,135,774, describes a method of imparting coffee stain resistance to polyamide textile substrates using phenyl vinyl ether/maleic acid copolymers. In addition, European Patent Publication Nos. 0,329,899(A2) and 0,328,822(A2) relate to inventions which provide stain resistance to carpeting using aromatic maleic anhydride polymers which purport to improve stain resistance while at the same time resisting yellowing as previously known materials do.

However, none of these patents disclose or suggest the combination of elements disclosed by the present invention which provide acid dye stain resist properties to nylon substrates such as carpeting which are durable through a substantial number of the detergent washings and also resist degradation or yellowing due to U.V., $NO_x$ and ozone exposure.

SUMMARY OF THE INVENTION

The subject invention relates to a method of imparting acid dyes stain resistant to polyamide substrates having improved durability of the stain resist agent to detergent washings, comprising: treating the polyamide substrate with an effective amount of a mixture of phenyl vinyl ether/maleic diacid copolymer and 2-(4-hydroxymethyl-phenoxy)-ethyl vinyl ether/maleic diacid copolymer or b) a copolymer obtained from the reaction of phenyl vinyl ether, 2-(4-hydroxymethyl-phenoxy)-ethyl vinyl ether and maleic anhydride, and c) mixtures thereof. In addition, the invention provides for a composition useful in imparting acid dye stain resistance with improved durability to detergent washings comprising a mixture of phenyl vinyl ether/maleic diacid copolymer and 2-(4-hydroxymethyl-phenoxy)-ethyl vinyl ether/maleic diacid copolymer, wherein the phenyl vinyl ether/maleic diacid component is the stain resist agent, and the 2-(4-hydroxymethyl-phenoxy)-ethyl vinyl ether/maleic diacid copolymer is added to improve the durability of the stain resist agent, and the combination of said composition with polyamide substrates, more particularly polyamide floor coverings and upholstery materials. In a particularly preferred embodiment, the invention utilizes 70–80 weight percent of the phenyl vinyl ether/maleic diacid copolymer and 30–20 weight percent of the 2-(4-hydroxymethyl-phenoxy)-ethyl vinyl ether/maleic diacid copolymer respectively with a molecular weight of the components within a particularly preferred range. In addition to having superior resistance to detergent washout, these compositions and the methods of application also are resistant to yellowing induced by exposure to U.V. light and $NO_x$, and fading by ozone.

DETAILED DESCRIPTION OF THE INVENTION

In the following detailed description of the invention the following terms have the meanings defined:

"Polyamide" shall mean the well known fiber-forming substance which is a long chain synthetic polyamide in which less than 85% of the amide-linkages are attached directly $$(-\underset{\underset{O}{\|}}{C}-NH-)$$

to two aromatic rings. Particularly preferred are poly(epsilon caprolactam)(polyamide 6) and poly(hexamethylene diamine adipamide) (polyamide 6,6).

"Copolymers" means any polymer derived from two or more dissimilar monomers.

"Textile substrate" means fiber or yarn which has been typically tufted, woven or otherwise constructed into fabrics suitable for use in home furnishings such as floor coverings, upholstery fabrics or the like.

"Fiber" means a profile-like material generally used in the fabrication of textile and industrial yarns and fabrics, generally characterized by having a length of at least 100 times its diameter, normally occurring in continuous filament, staple, monofilament, tow or tape form, and generally suitable for use in the manufacture of floor coverings, upholstery and apparel.

A presently preferred acid dye stain resist composition comprises a mixture of phenyl vinyl ether/maleic diacid copolymer and 2-(4-hydroxymethyl-phenoxy)-ethyl vinyl ether/maleic diacid copolymer.

More specifically, the phenyl vinyl ether compound can be represented by the following structural formula.

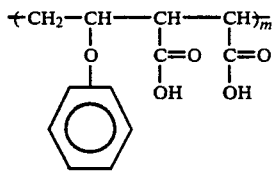

where "m" is about 5–86 and weight average molecular weight range is about 1200–20,000.

The 2-(4-hydroxymethyl-phenoxy)-ethyl vinyl ether/maleic diacid copolymer can be represented by the following structural formula:

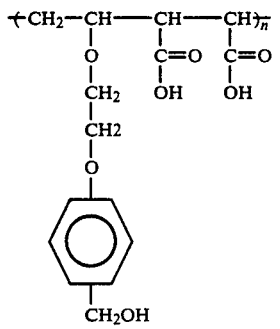

where "n" is about 64–258 and weight average molecular weight range of about 20,000 to 80,000.

The terpolymer represented by the following structural formula can also be used in the invention:

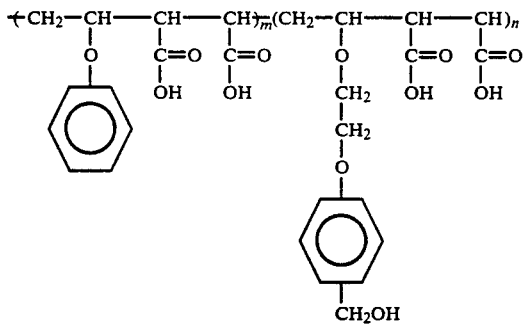

where m=40–69
n=17–30
and $m_w$=15,000–26,000

The ratio of the above mixture of compounds preferably ranges anywhere from 50–80 weight percent phenyl vinyl ether/maleic diacid copolymer based on the maleic anhydride moiety and 50–20% 2-(4-hydroxymethyl-phenoxy)-ethyl vinyl ether/maleic diacid copolymer based on the maleic anhydride moiety respectively. Presently preferred is a ratio of copolymers of 65–80 weight percent of phenyl vinyl ether/maleic diacid copolymer and 35–20% of 2-(4-hydroxymethyl-phenoxy)-ethyl vinyl ether/maleic diacid copolymer respectively.

In a preferred embodiment, we have found that the composition comprises the mixture of phenyl vinyl ether/maleic diacid copolymer and 2-(4-hydroxymethyl-phenoxy)-ethyl vinyl ether/maleic diacid copolymer wherein the phenyl vinyl ether/maleic diacid copolymer has a weight average molecular weight between about 1,200 and 20,000, preferably between about 1,200 and 15,000, more preferably between about 2,000 and 10,000, and most preferably between 2,000 to 4,000 below; and the 2-(4-hydroxymethyl-phenoxy)-ethyl vinyl ether/maleic diacid copolymer has a weight average molecular weight between 20,000 and 80,000, most preferably between 50,000 and 60,000 (measured as described in the METHODS Section). The terpolymer of the phenyl vinyl ether/maleic diacid copolymer and 2-(4-hydroxymethyl-phenoxy)-ethyl vinyl ether/maleic diacid copolymer anhydride terpolymer is in the range of 15,000 to 25,000 $m_w$.

The copolymer or mixture of the present invention is generally applied at a pH range between 3.5–5 preferably 4–4.5.

The copolymer or mixture is applied to the fiber substrate at about 70° C. for three minutes and then dried in an oven at 105°–120° C. for 20 minutes.

In a particularly preferred embodiment, copolymer mixtures proving particularly good results are obtained on carpet having improved stain resistance including resistance to detergent washings and yellowing when the phenyl vinyl compound is present in quantities of 65–80 weight percent of the mixture and the ethyl vinyl compound is present in quantities ranging from 35–20 weight percent weight of the mixture; the phenyl vinyl copolymer has a weight average molecular weight between about 2,000 and 4,000 and the ethyl vinyl copolymer has a weight average molecular weight between 50,000 and 60,000; the copolymer mixture is deposited on the fiber in concentrations ranging from 1–2% by weight of the fiber at a pH range between 4–4.5 and a temperature from 50° C. to 100° C. and then dried at 105° C. to 120° C. for at least about 20 minutes. By using this combination of process and composition ranges, we have provided a durable stain resistant additive for polyamide fibers which has improved resistance to detergent washings and is also resistant to U.V., ozone and $NO_x$ fading.

PRECURSOR PREPARATION

Synthesis of Phenyl Vinyl Ether Monomer—Phenyl vinyl ether was prepared according to the method of Mizuno et al. in Synthesis, a publication by George Thieme Verlag of Stuttgart, Germany, (1979 No. 9, p. 688) by dehydrohalogenation of phenyl 2-Bromo-ethyl ether with aqueous sodium hydroxide utilizing tetra-n-butylammonium hydrogen sulfate as the phase transfer catalyst. The reaction is exothermic and is completed within 1.5 hours at ambient temperature. The monomer is purified by fractional distillation.

Preparation of Phenyl Vinyl Ether/Maleic Anhydride Copolymer—Phenyl vinyl ether (88.1 g, 0.7341 moles), and maleic anhydride (71.9 g, 0.7341 moles) were dissolved in 1224 ml of 1,2-dichloroethane. The solution was placed in a 2 liter three necked round bottom flask equipped with a thermometer, a condenser, and nitrogen inlet, and it was purged with nitrogen for half an hour. Then VAZO® 67 2,2'-AZO Bis (2-methyl butane-nitrile) (4.7 g, 0.02447 moles) and butanethiol (11.8 ml, 0.1101 moles) were added under nitrogen. The polymerization was carried out at 60° C. for 24 hours or longer until complete monomer conversion. The polymer was isolated by precipitation in hexane.

Aqueous Dissolution of Phenyl Vinyl Ether/Maleic Anhydride Copolymer—A slurry was made with 5.4 g of phenyl vinyl ether/maleic anhydride copolymer and 13.2 g of water. Then 8.44 g of a 20% aqueous NaOH solution was added to the slurry and this was heated to 75° C. with stirring for 2.5 hours. The solution was cooled to room temperature. A viscous orange solution was obtained with a pH of about 9. The pH of this solution was then adjusted to 5 with 5% aqueous acetic acid solution.

Preparation of 2-(4-Hydroxymethyl-Phenoxy)-Ethyl Vinyl Ether—In a 500 ml three necked round bottom flask equipped with an overhead stirrer and a reflux condenser were placed 21.7 g of 4-hydroxybenzyl alcohol, and 65 ml of dimethyl sulfoxide. To this solution was slowly added 6.99 g of NaOH, while keeping the temperature below 45° C. After the addition of NaOH was completed, 20.4 ml of 2-chloroethyl vinyl ether was added slowly while keeping the temperature 60° C. The reaction mixture was heated at this temperature for 2 hours, and the progress of the reaction was followed by GC. After cooling, the reaction product was added dropwise to 500 ml of water. The precipitated product was then filtered and redissolved in 500 ml of diethyl ether. The ether layer was washed one time with 100 ml of 3% aqueous NaOH and two times with 100 ml portions of distilled water, was then dried with sodium sulfate, filtered and evaporated. These reaction conditions give a 55% yield of 2-(4-hydroxymethyl-phenoxy)-ethyl vinyl ether.

Preparation of 2-(4-Silyloxymethyl-Phenoxy)-Ethyl Vinyl Ether Via Reaction with Chlorotrimethylsilane—In a three necked round bottom flask equipped with a stirring bar, addition funnel, thermometer, and nitrogen inlet were placed 33 ml of toluene, 5.0 g of 4-(hydroxymethyl-phenoxy)-ethyl vinyl ether and 2.73 g of triethylamine. To this, a solution of 2.94 g of chlorotrimethyl silane in 33 ml of toluene was added over a period of 15 minutes while keeping the temperature below 35° C. The mixture was then heated to 60° C. for one hour. After cooling, the inorganic salt which precipitated was filtered off, and the toluene was evaporated. An 87% yield of 2-(4-Silyloxymethyl-phenoxy)-ethyl vinyl ether was obtained.

Preparation of 2-(4-Silyloxymethyl-Phenoxy)-Ethyl Vinyl Ether/Maleic Anhydride Copolymer—In a 50 ml three necked round bottom flask equipped with a thermometer, a condenser and a nitrogen inlet, was placed a solution of 4 g of 2-(4-silyloxymethyl-phenoxy)-ethyl vinyl ether and 1.47 g of maleic anhydride in 25.1 ml of 1,2-dichloroethane. The system was purged with nitrogen for 30 minutes. Then 96 mg VAZO® 67, and 0.24 ml butanethiol were added under nitrogen. The polymerization was carried out at 60° C. for twenty four hours or longer until complete monomer conversion. The copolymer was isolated by precipitation in hexane.

Aqueous Dissolution of 2-(4-SilyloxymethylPhenoxy)-Ethyl Vinyl Ether/Maleic Anhydride Copolymer—A slurry was made with 20 g of 2-(4-silyloxymethyl-phenoxy)ethyl vinyl ether/maleic anhydride copolymer in 498 g of distilled water. To this was added 108 g of a 20% aqueous NaOH solution. The slurry was heated to 75° C. for 48 hours. The reaction was then cooled to room temperature to give a 3.37% concentrated solution of 2-(4-hydroxymethyl-phenoxy)-ethyl vinyl ether/maleic diacid at pH 12.7.

Phenyl Vinyl Ether/2-(4-Hydroxymethyl-Phenoxy)—Ethyl Vinyl Ether/Maleic Anhydride Terpolymer—In a three necked round bottom flask is placed a solution of Phenyl vinyl ether (5.26g), 2-(4-silyloxymethyl-phenoxy)-ethyl vinyl ether (5.0g) and maleic anhydride (6.13 g) in 104 ml of 1,2-dichloroethane. The system is purged with nitrogen for 20 minutes. Then 0.40 g of VAZO 67 and 1.0 ml of butanethiol were added, followed by another twenty minutes purging with nitrogen. The reaction mixture was then heated at 60° C. for seventeen hours. The reaction mixture was then cooled at room temperature and air was allowed into the system. The terpolymer was isolated by precipitation in hexane. The solid was analyzed by IR and NMR.

Aqueous Dissolution of Phenyl Vinyl Ether/2-(4-hydroxymethyl-Phenoxy)-Ethyl Vinyl Ether/Maleic Anhydride Terpolymer—A slurry was made with 9.8 gm of the Phenyl Vinyl Ether/2-(4-hydroxymethyl-phenoxy)-ethyl vinyl ether/maleic anhydride terpolymer in 174.5 gm of distilled watter. To this was added 11.8 g of a 20% aqueous NaOH solution. The reaction was done in a 500 ml three necked round bottom flask equipped with a condenser, thermometer, and overhead stirrer. The mixture was heated to 70° C. with stirring for 3 hours. The reaction was cooled to room temperature to give a 4.39% solution of the terpolymer at a pH of 7.6.

Application of Phenyl Vinyl Ether/Maleic Diacid Copolymer onto Nylon-6 Flat Fabric—A 30% solution of the phenyl vinyl ether/maleic diacid made as described above, was brought to pH 5 and to a 20% concentration using acetic acid and water to make the phenyl vinyl ether/maleic diacid master batch solution. For application onto polyamide substrates this solution was then further diluted with water, while the pH was adjusted to the desired application pH with sulfamic acid. The concentration of the copolymer in this solution was that necessary to obtain the desired add-on level of the copolymer on the flat fabric upon impregnation, where the add-on level was calculated by multiplying our fixed 220% wet pick-up times the concentration of the copolymer in the solution. Nylon-6 flat fabric was impregnated with the copolymer solution, using a liquor ratio of 15 g of solution to 1 g of fabric, at 60°-75° C. for 3 minutes. The flat fabric was then squeezed between two rollers to a 220 percent wet pick up. The fabric can then be either allowed to air dry or be steamed or be annealed in the oven at 105° to 115° C.

Application of 2-(4-Hydroxymethyl-Phenoxy)-Ethyl Vinyl Ether/Maleic Diacid Copolymer onto Nylon-6—A 3.37%, pH 12, master batch solution of 2-(4-hydroxymethyl-phenoxy)-ethyl vinyl ether/maleic diacid copolymer was brought to pH 4 using aqueous sulfamic acid and then diluted to about exactly 1%. Nylon-6 flat fabric was then impregnated with the 1% copolymer solution at pH 4, using a liquor ratio of 15 g of solution to 1 g of nylon fabric. The application temperature ranged from 60° to 70° C. for 3 minutes. The impregnated flat fabric was squeezed between two rollers to a wet pick-up of 220%, such that the polymer add-on level was 2%, calculated as described above for the phenyl vinyl ether/maleic diacid copolymer. The flat fabric was then dried in the oven for 20 minutes at 115° C.

EXAMPLES

Having described the preparation of the precursors above, examples of the invention follow:

These examples describe the steps used in application of the ethyl vinyl and the phenyl vinyl mixtures and terpolymer onto a polyamide 6 fiber substrate.

EXAMPLE 1

Application of the Mixture of Phenyl Vinyl Ether/-Maleic Diacid Copolymer and 2-(4-Hydroxymethyl-Phenoxy)-Ethyl Vinyl Ether/Maleic Diacid Copolymer onto Polyamide-6 Flat Fabric or Knitted Sleeves—The desired combination of phenyl vinyl ether/-maleic diacid copolymer and 2-(4-hydroxymethyl-phenoxy)-ethyl vinyl ether/maleic diacid copolymer was prepared using the master batch solutions as described above, to a final total concentration of copolymers of 0.88%. The pH was adjusted with sulfamic acid to the pH of 4. The Nylon-6 flat fabric or knitted sleeve was then impregnated with the solution of copolymers at the pH of 4, at a temperature of 60° to 75° C., for 3 minutes. The polyamide substrate was then squeezed in between two rollers to a 220% wet pick-up to obtain a 2% add-on level of copolymer mixture on the flat fabric. The flat fabric was then heated in the oven of 115° C. for 20 minutes.

EXAMPLE 2

Application of the Combination of Phenyl Vinyl Ether/Maleic Diacid and 2-(4-Hydroxymethyl-Phenoxy)-Ethyl Vinyl Ether/Maleic Diacid Copolymer onto Nylon-6 Carpet—Solutions of the desired ratio of phenyl vinyl ether/maleic diacid and 2-(4-hydroxymethyl-phenoxy)-ethyl vinyl ether/maleic diacid or the terpolymer at a 0.88% total concentration, were prepared using the master batch solutions described above. The pH was adjusted to 4 with sulfamic acid. A known weight of the carpet was immersed tufts side down for 5 minutes in the copolymers mixture at 77° C. The liquor ratio was 25 ml solution to 1 g of carpet fiber. After the 5 minute immersion, the carpet was centrifuged to remove excess liquid. The carpet sample was weighed out and the amount of wet pick-up was calculated from the weight difference between the original carpet sample and the centrifuged carpet sample. Based on the weight of the nylon tufts in the corresponding carpet piece, a 2% copolymer mixture add-on was obtained. When it was desired to vary the percent add-on, the concentration of the copolymer mixture was varied. The carpet was then dried in the oven at 120° C. for 30 minutes.

The following examples show the improved durability, resistance to ozone and $NO_x$ exposure and lightfastness obtained by the compositions and methods of application of this invention. The test procedures and stain evaluations referred to herein follow:

Stain Test Procedure—Unsweetened Cherry Kool-Aid® (0.14 oz) was dissolved in two quarts of water. Twenty milliliters of this solution was placed in a vial, and the Nylon 6 flat fabric was immersed in the solution with strong agitation to achieve complete wetting of the fabric. The fabric was left in contact with this solution for 1.5 minutes, and then it was removed and placed in a beaker. The remaining solution was combined with another 5 ml of Kool-Aid® solution and it was poured onto the soaked flat fabric from a 12" height. After one minute, the Kool-Aid solution was drained, and the sample was allowed to stand for 4 hours. At the end of this period, the sample was rinsed with cold tap water and left to dry. To test carpet samples, the same procedure was used. The carpet pieces weighed about 3 g, and the amount of Kool-Aid used was 50 ml.

Stain Evaluation—The stain resistance was measured by the following technique. A 0–10 scale was used to rate the stain protection, with a score of 0 for a stain similar to stain in a control polyamide substrate, and a rating of 10 when the stain was not detectable. The rating was done by visual evaluation by the same panel of evaluators.

Detergent Wash Procedure A—Fourteen grams of All-in-One detergent was emptied into 2 quarts of room temperature (23° C.) water and shaken until totally in solution. For 3 g of nylon fiber to be tested, 50 ml of ALL-IN-ONE detergent is used in the detergent wash. The ALL-IN-ONE solution is heated to 60° C. (+−2° C.), the nylon sample is then immersed in the hot solution for 5 minutes with agitation, removed, rinsed with cold tap water, padded with paper towels, and then dried in an oven at 120° C. for 20 minutes. The samples are then ready to be tested for stain resistance, in order to evaluate the durability of the stain protection.

Detergent Wash Procedure B—Detergent cleaning of Installed Carpet is usually carried out with a machine which wets the carpet with a 60° C. detergent solution and sucks up said solution, at a rate of 0.8 feet per second, the carpet is not rinsed and it is just allowed to air dry. Therefore, this procedure was simulated in the lab by dunking the piece of carpet (3 g) in 50 ml of hot detergent, until the carpet is completely wet. The carpet piece was then removed and it was allowed to air dry without any rinsing. The stain protection was evaluated after the sample was completely dried.

Cold Detergent Wash Procedure C—Fourteen grams of ALL-IN-ONE Detergent were emptied into 2 quarts of room temperature (23° C.) water and shaken until totally in solution. The nylon sample was immersed in the ALL-IN-ONE solution at room temperature for 5 minutes (50 ml detergent per 3 g of nylon). The sample is also agitated to make sure it wets out. The sample is removed, padded between paper towels, and allowed to air dry. The sample is now ready to be tested for stain protection.

Detergent Procedure D—Procedure D is a steam cleaning procedure as performed by carpet cleaners. It is also called in the trade Hot Water (steam) Extraction, abreviation HWE. The carpet piece was divided in two and marked 1X and 2X indicating 1 and 2 regular cleaning cycles. The detergent used was Certified All-In-One. One cleaning cycle consists of 1 pass of detergent spray with vacuum, 1 pass vacuum, then turn sample 180° and 1 pass detergent with vacuum and 1 pass vacuum. The samples were dried 24 hours between the first and second cleaning.

The Certified All-In-One detergent is a powder with mostly sodium carbonate buffer giving a pH of 10.3 to 10.5. This is considered a harsh detergent by current practice.

Determination of the Weight Average Molecular Weight of Phenyl Vinyl Ether/Maleic Copolymer—The weight average molecular weight of the phenyl vinyl ether/maleic anhydride copolymer or the terpolymer was calculated using a set of Phenogel columns of the 10 micron particle size, covering a range of 50–500 angstroms pore diameter, 300 mm length, 7.8 mm I.D.

and with tetrahydrofuran as eluant at a flow rate of 1 ml per min.

Determination of the Weight Average Molecular Weight of 2-(4-Hydroxymethyl-Phenoxy) Ethyl Vinyl Ether/Maleic Copolymer—Approximately 0.1% solution in the eluant buffer was injected onto the size exclusion column using the following chromatographic conditions. A Varian 5060 Liquid Chromatograph equipped with Beckman 165 Multi-channel UV/Vis. Detector and Hewlett Packard 3390A Reporting Integrator. The Columns used were Bio-Rad's Bio-Sil® TSK-400, 300×7.5mm (13 um). The eluant was 0.05 M CAPS (3-[cyclohexylamino]-1-propanesulfonic acid) at pH=9 with a flow rate of 1 mL/min.

In the following Tables, the compositions, molecular weights, ratios and process conditions are the same as Example 2 unless otherwise noted.

Table I: Stain Resist Performance

This table shows that:

1) Phenyl vinyl ether/maleic diacid protects Polyamide 6 against acid dyes but the protection is lost as the treated substrate is washed with detergent (Comparative B) (procedure a or b).

2) 2-(4-hydroxymethyl-phenoxy)-ethyl vinyl ether/-maleic diacid copolymer does not protect Nylon 6 against acid dyes. (Comparative C).

3) The combination of Phenyl vinyl ether/maleic diacid copolymer and of 2-(4-hydroxymethyl-phenoxy)-ethyl vinyl ether/maleic diacid copolymer protects Nylon 6 against acid dyes and the protection remains after the substrate has been deterged washed by procedures A or B (Example 3).

4) A mixture of 70 weight percent phenyl vinyl ether and 30% 2-(4-hydroxymethyl-phenoxy)-ethyl vinyl ether can be polymerized together with maleic anhydride to give a terpolymer which is also effective to protect against acid stains, and retains the protection after detergent washings (Example 4).

TABLE I

| | Copolymer | % wof* | Stain Protection | | | |
|---|---|---|---|---|---|---|
| | | | | Detergent Washings | | |
| | | | Unwashed | Procedure A | Procedure B | Procedure C |
| (Comp. A) | Styrene/Maleic Acid | 2 | 7 | 0 | 0 | 0 |
| (Comp. B) | Phenyl Vinyl Ether/ Maleic diacid (I) | 2 | 10 | 0 | 0 | 0 |
| (Comp. C) | 2-(4-hydroxymethyl-phenoxy)-ethyl vinyl ether/maleic diacid copolymer (II) | 2 | 0 | 0 | 0 | 0 |
| Example 3 | Mixture of 70% (I) and 30% (II) | 2 | 10 | 10 | 10 | 10 |
| Example 4 | Phenyl Vinyl Ether/ 2-(4-Hydroxymethyl-Phenoxy)-Ethyl Vinyl Ether/Maleic Diacid terpolymer | 0.9 | 10 | | 10 | |

Application pH 4
*WOF: Weight % of Copolymer Used on Weight of Fiber

Table II. Effective Mixture Composition Range

This table shows the composition range of the mixture of phenyl vinyl ether/maleic diacid copolymer (I) and 2-(4-hydroxymethyl-phenoxy)-ethyl vinyl ether/-maleic diacid copolymer (II) which is effective in conferring stain protection with improved detergent washing durability, to polyamide substrates. From this table it can be seen that the two comparative examples, namely 90%/10% and 40%/60%, are deficient in that their stain protection after detergent wash is deficient compared to the examples 5–7 where the stain protection persists through detergent washing.

TABLE II

| Composition of Stain Resist Copolymer (I)/ Copolymer (II) | % wof | Stain Protection | |
|---|---|---|---|
| | | Unwashed | Detergent Washed (A) Flat Fabric Substrate |
| (Comparative D) 90%/10% | 2 | 10 | 6 |
| Example 5 80%/20% | 2 | 10 | 10 |
| Example 6 70%/30% | 2 | 10 | 10 |
| Example 7 50%/50% | 2 | 10 | 10 |
| (Comparative E) 40%/60% | 2 | 10 | 6 |

Application pH 4 for 3 minutes at 70° C.

Table III. Importance of the Application pH

This table shows that the application pH has a great effect on the retention of the Stain Protection upon washings. The protection increases as the pH goes down from 6 to 4 (Comparative F to G) (Example 8). The substrates used were Nylon 6 knitted sleeves containing $TiO_2$ delusterant. The copolymer mixture was 70% (I) and 30% (II). The copolymers mixture add on was 2% (that is 2 g copolymers per 100 g of polyamide substrate).

TABLE III

| Application pH | Stain Protection | |
|---|---|---|
| | Unwashed | Detergent Procedure A Delustered Knitted Sleeve |
| Example 8 pH 4 | 10 | 10 |
| (Comparative F) pH 5 | 10 | 3 |
| (Comparative G) pH 6 | 10 | 3 |

Table IV. Percent Add-On

This table shows the durability of the stain protection obtained by adding various weight percent of the copolymers mixture onto carpet. Copolymer mixture used was 70% (I) and 30% (II) at pH 4. As can be seen, the effectiveness of this stain resist agent persists down to below about 0.6% wof.

TABLE IV

| Copolymer mixture Percent Add-On | Stain Protection Unwashed | Detergent Procedure (B) on carpet substrate |
|---|---|---|
| Example 9 2% | 10 | 10 |
| Example 10 1.73% | 10 | 10 |
| Example 11 1% | 10 | 10 |
| Example 12 0.6% | 10 | 10 |
| (Comparative H) 0.3% | 10 | 7 |

Table V.

Table V shows ozone and $NO_x$ fastness of the Nylon 6 flat fabric treated with a 2% add-on of the mixture of 70% copolymer (I) and 30% copolymer (II) applied at pH 4. As can be seen, the ozone fastness improves as does the nitrogen fastness as shown in Example 13 verses the control.

TABLE V

| Copolymer | % add | Gray Scale Rating* Ozone Fastness(1) | Oxide of Nitrogen Fastness(2) |
|---|---|---|---|
| Sample | Mixture | on | (5 cycles) | (1 cycle) |
| Control** | — | — | 1 | 3–4 |
| Example 13 | | 3 | 3 | 4 |

*AATCC evaluation procedure
(1)AATCC 129-1985
(2)AATCC 164-1987
**Regular flat fabric Table VI. Lightfastness of the Polyamide Substrate Treated with the Mixture of Copolymer (I) and (II)

This table shows that the copolymer mixture applied at the pH of 4, which is the appropriate pH to obtain durability of the stain resist, gives rise to yellowing upon a lightfastness test. This table also shows that this yellowing can be corrected if after annealing of the copolymer mixture of the polyamide substrate, the substrate is rinsed with ambient tap water and allowed to dry.

TABLE VI

| | Copolymer Mixture Applied @ pH 4 | % Add On | Gray Scale Rating* Light-fastness[1] before water rinse | 40 cycles after water rinse |
|---|---|---|---|---|
| Control** | — | — | 3–4 | 3–4 |
| Example 14 | | 2 | 2 | 3–4 |

TABLE VI-continued

70% (I)/30% (II)

*AATCC evaluation procedure
(1)AATCC 129-1985
(2)AATCC 164-1987
**Regular flat fabric Table VII. Durability of Stain Protection After Detergent Washings This table shows that the durability of the Stain Protection is retained after several detergent washings. Two detergent wash procedures are used, one for flat fabric and one for carpet. In the detergent wash procedure for flat fabric, the sample is immersed in hot detergent (60° C.) for five minutes, then rinsed followed by hot air drying (this is referred to as procedure A). This is intended for uses in apparel or when the substrate can be easily handled in order to be rinsed and hot air dried. For installed carpets, the typical procedure is to pass the steam cleaning machine over the carpet at a rate of 0.8 foot/sec and no rinsing. This procedure has been mimicked in our experiments by dunking the carpet in 60° C. detergent (both All-in-One and Advanced Generation detergent) until saturated with hot detergent then allowing the carpet to air dry at room temperature, without any rinsing (this is procedure B).

TABLE VII

| Application pH 4 Copolymer Mixture | % Add-On | Stain Protection Unwashed | Detergent Wash (A) flat fabric 1× | 2× | 3× | 5× | Detergent Wash (B) carpet 1× | 2× | 3× | Detergent Wash (D) carpet 1× | 2× |
|---|---|---|---|---|---|---|---|---|---|---|---|
| Control Flat Fabric | — | 0 | | | | | | | | | |
| Control Carpet | — | 0 | | | | | | | | | |
| Example 15 50% (I) 50% (II) | 2 | 10 | 10 | 10 | 9 | 9 | | | | | |
| Example 16 70% (I) 30% (II) | 2 | 10 | | | | | 10 | 10 | 10 | 10 | 10 |

From the above, it can be seen that the present invention provides a relatively simple method of providing a stain resistant additive to a carpet which is durable through numerous detergent washings and also provides enhanced resistance to U.V., ozone and $NO_x$ fading and discoloration.

Although general and preferred embodiments of the invention have been described above, the invention should be determined with reference to the following claims and equivalents thereof.

We claim:

1. An article of manufacture comprising a carpet manufactured from fibers of polyamides 6 or 6,6 having a durable acid dye stain resist agent on the fibers thereof, wherein the stain resist agent on the fibers of comprising (a) mixture of 70–80 weight percent of phenyl vinyl ether/maleic diacid copolymer respectively or (b) a copolymer obtained by the reaction of phenyl vinyl ether, 2-(4-hydroxymethyl-phenoxy)-ethyl vinyl ether and maleic anhydride or mixtures thereof wherein the mixture or copolymer is deposited on the fiber in concentrations ranging from 1–2% by weight of the fiber at a pH range between 4–4.5 and a temperature from about 50° C. to 100° C. and then dried at 105° C. to 120° C. for at least about 20 minutes whereby a durable stain resistant carpeting is provided which has improved resistance to detergent washings and is also resistant to UV, ozone and $NO_x$ fading or yellowing.

* * * * *